US005974807A

United States Patent [19]

Gao et al.

[11] Patent Number: 5,974,807

[45] Date of Patent: Nov. 2, 1999

[54] PULSE TUBE REFRIGERATOR

[75] Inventors: Jin Lin Gao, Allentown, Pa.; Yoichi Matsubara, Funabashi; Yu Hiresaki, Tokyo, both of Japan

[73] Assignee: Suzuki Shokan Co., Ltd., Tokyo, Japan

[21] Appl. No.: 08/957,624

[22] Filed: Oct. 24, 1997

[30] Foreign Application Priority Data

Oct. 24, 1996 [JP] Japan ..... 8-282296

[51] Int. Cl.[6] ..... F25B 9/00

[52] U.S. Cl. ..... 62/6; 165/4

[58] Field of Search ..... 62/6, 467, 196.2; 165/4

[56] References Cited

U.S. PATENT DOCUMENTS

| | | | |
|---|---|---|---|
| 5,186,765 | 2/1993 | Arai et al. | 148/301 |
| 5,332,029 | 7/1994 | Tokai et al. | 62/6 |
| 5,398,512 | 3/1995 | Inaguchi et al. | 62/6 |
| 5,412,952 | 5/1995 | Ohtani et al. | 62/6 |
| 5,435,136 | 7/1995 | Ishizaki et al. | 60/517 |
| 5,449,416 | 9/1995 | Arai et al. | 148/301 |
| 5,487,272 | 1/1996 | Nagao | 62/6 |
| 5,647,218 | 7/1997 | Kuriyama et al. | 62/6 |

FOREIGN PATENT DOCUMENTS

| | | |
|---|---|---|
| 7-101134 | 1/1995 | Japan . |
| 7-92285 | 9/1995 | Japan . |

OTHER PUBLICATIONS

J.L. Gao and Y. Matsubara, An Inter–Phasing Pulse Tube Refrigerator for High Refrigeration Efficiency, 16th International Cryogenic Engineering Conference? International Cryogenic Materials Conference and Industrial Exhibition<ay 20–24, 1996 6 pages.

Energy Week Conference Exhibition, Jan. 28, 1997 10 pages.

*Primary Examiner*—William Doerrler

*Attorney, Agent, or Firm*—Lowe Hauptman Gopstein Gilman & Berner

[57] ABSTRACT

A pulse tube refrigerator which can generate cryogenic temperatures of below 10 K includes first and second refrigeration stages. Each stage includes a pulse tube and an associated regenerator provided at the low temperature side of the pulse tube. A pressure fluctuation generator having a compressor and a first to a fourth valve is provided at the high temperature side of each regenerator. The high temperature sides of each pulse tube are connected by a continuous channel while the high temperature side of each pulse tube and the high temperature side of each regenerator are connected by a by-pass channel. A magnetic material having a rare-earth element and a transition metal is used as a regenerative material for the regenerator. When pressure fluctuation is generated in each pulse tube at the phase difference angle of 180°, respectively, a working gas is transferred between the high temperature sides of each pulse tube, therefore, the phase angle between the pressure fluctuation in each pulse tube and the displacement of the working gas is optimized. Further, the flow amount of the operating gas sent to each regenerator is limited using a by-pass channel.

15 Claims, 7 Drawing Sheets

PULSE TUBE REFRIGERATOR

BACKGROUND OF THE INVENTION

1. Field of the Invention

The present invention relates to a pulse tube refrigerator, for instance, the pulse tube refrigerator applied to a cryopump and the like.

2. Description of the Related Art

A pulse tube refrigerator is a refrigerator with which low temperatures of less than 30 K (kelvin) can be obtained, and in recent years, it is desirable to have a refrigerator which has a refrigeration capacity of making cryogenic temperatures of less than 10 K, particularly, a 4 K level, in practice.

A pulse tube refrigerator, a basic type of refrigerator invented by Giford, is built up with only a regenerator and pulse tubes in addition to a compressor. Except for the basic type, the pulse tube refrigerator is improved in refrigeration efficiency by making a phase angle between pressure fluctuation in the pulse tube and displacement of a working gas (a gas column, gas piston) in a good condition, through providing various phase control mechanisms in the high temperature side of the pulse tube.

The pulse tube refrigerator includes such phase control mechanisms as an orifice type in which a buffer (reservoir tank) is connected to the high temperature side of the pulse tube through an orifice, a double inlet type in which a by-pass valve which connects the high temperature side of the pulse tube with the high temperature side of the regenerator, is added to the orifice type, and a four-valve type in which the high pressure side and the low pressure side of the compressor is connected to the high temperature side of the pulse type also, and so forth.

However, since the orifice type and the double inlet type have the buffer, there arises a disadvantage that the refrigerator becomes big. On the other hand, the four valve type has also a disadvantage that it is not easy to obtain a high refrigeration efficiency in the cryogenic temperature area of below 10 K, though it can be downsized.

Here, aside from the disadvantages in the pulse tube refrigerator, improvement has been made for a regenerator used in the refrigerator to boost the refrigeration efficiency in the cryogenic temperature area below 10 K.

That is, hitherto, copper or copper alloy has been used as a regenerator in the refrigerator which generates higher than 30 K in the cryogenic temperature area, and lead is used in the refrigerator for the use in the temperature of 10 K and 30 K. This is because each metal has sufficient specific heat in the temperature areas of each refrigerator so that a sufficient regenerative capacity is produced.

However, copper, copper alloy, and lead is the regenerator, have the property that each specific heat becomes low, in case of copper or copper alloy at below 30 K, and in case of lead at below 10 K. Therefore, in the lower temperature areas, no matter how much energy in applied to the refrigerator, sufficient regeneration can not be performed and consequently the cryogenic temperature can not be obtained.

For such disadvantages, the improvement in the regenerative material by using specific magnetic materials has been tried. That is, in the Japanese Patent Publication No Hei 7-92286, the Japanese Patent Publication No Hei 7-101134, U.S. Pat. No. 5,186,765 and U.S. Pat. No. 5,449,416, it is disclosed that magnetic material composed of a rare-earth element and a transition metal is used as a regenerator which can maintain a large specific heat even in the cryogenic temperature below 10 K. As the rare-earth metals, Y, La, Ce, Pr, Nd, Pm, Sm, Eu, Gd, Tb, Dy, Ho, Er, Tm, and Yb are cited, and as the transition metals, Ni, Co, and Cu are cited in each bulletin.

It should be mentioned that each bulletin shows that a refrigerator using these regenerative material generates the cryogenic temperature below 10 K, the refrigerator written in the bulletins has a movable portion in a low temperature (an expander or displacer) and is different from the pulse tube refrigerator relating to the present invention.

As above, since the magnetic regenerative material made of the rare-earth element and the transition metal show an excellent property at low temperatures below 10 K, it is conceivable that the application of the regenerative material to the regenerator of the four valve type pulse tube refrigerator also is effective for the improvement of the refrigeration efficiency and the achievement of the practical use level at low temperatures below 10 K.

However, when the magnetic regenerative material is combined with the four valve type pulse tube refrigerator, the improvement of the refrigeration efficiency will not be obtained in practice. The reason is that sufficient refrigeration efficiency may not be obtained through the four valve type pulse tube refrigerator itself.

That is, in four valve type, the working gas can come and go between the high temperature side of the pulse tube and the compressor when connecting the compressor with the high temperature side of the pulse tube through the orifice, valve, and the like. Therefore an excess load is exerted upon the compressor, resulting in the waste of refrigeration energy, which makes it difficult to enhance the refrigeration efficiency.

If the refrigeration efficiency is low, even once the cryogenic temperature below 10 K is created, the refrigeration capacity thereof is as little as at the milliwatt level. Then, there arises a disadvantage that if the input energy (power consumption) is not enough, the cryogenic temperature below 10 K can not be obtained.

In other words, when the magnetic regenerator is combined with the four valve type pulse tube refrigerator, with a small power consumption, the refrigerator can not continue to drive to the cryogenic temperature in which the specific property of the regenerative material is exploited.

It is an object of the present invention to provide a pulse tube refrigerator which generates cryogenic temperatures of below 10 K with low power consumption and with reduced size.

SUMMARY OF THE INVENTION

A pulse tube refrigerator of the present invention is provided with a first pulse tube refrigerating means having a pulse tube and a regenerator arranged at the low temperature side of the pulse tube, a second pulse tube refrigerating means similarly having a pulse tube and a regenerator arranged at the low temperature side of the pulse tube, a pressure fluctuation generating means for generating the pressure fluctuation of working gas arranged in the high temperature side of each regenerator in the first and second pulse tube refrigerating means, a continuous channel which connects the high temperature side of the pulse tube in the first pulse tube refrigerating means with the high temperature side of the pulse tube in the second pulse tube refrigerating means, and a by-pass channel which connects the high temperature sides of the pulse tube in the first pulse tube refrigerating means with high temperature sides of the regenerator and at the same time the high temperature side of the pulse tube in the second pulse tube refrigerating means with the high temperature side of the regenerator, and at least a regenerative material of the regenerators contains a magnetic material consisting of a rare-earth element and a transition metal.

Here, the rare-earth metal is selected from Y, La, Ce, Pr, Nd, Pm, Sm, Eu, Gd, Tb, Dy, Ho, Er, Tm, and Yb, and the transition metal is selected from Ni, Co, and Cu.

In the present invention, the following effects can be expected.

Effect 1) When pressure fluctuation is generated in each pulse tube of the first and second pulse tube refrigerating means, for instance, at an angle of 180° in phase difference with a pressure fluctuation generator, since the high temperature sides of each pulse tube are connected with each other through the connecting channel, once refrigeration is generated in one of the pulse tube refrigerating means, a portion of the operation gas moves from the high temperature side of the pulse tube of the other pulse tube refrigerating means to the high temperature side of the pulse tube of the former pulse tube refrigerating means, a phase angle between the pressure fluctuation in the pulse tube and displacement of working gas (gas column, gas piston) of the former pulse tube refrigerating means becomes optimum through the above described gas movement. And when refrigeration is generated by the other pulse tube refrigerating means, the former pulse tube refrigerating means similarly reacts, and the phase angle between the pressure fluctuation in the pulse tube and displacement of the working gas of the other pulse tube refrigerating means also becomes optimum. In other words, in the first and second pulse tube refrigerating means, it is not necessary to provide a buffer or an orifice, valve and the like at the high temperature side of the pulse tube to optimize the phase angle between the pressure fluctuation and displacement of the working gas in each pulse tube. Accordingly, since the conventional sophisticated phase control mechanism becomes unnecessary, an excess compression work in the pressure fluctuation generator is not required so that the refrigeration efficiency is improved.

Further, since the conventional buffer is not required because of the effect 1), down sizing of the refrigerator can be achieved.

Effect 2) Since the high temperature sides of each pulse tube and the high temperature sides of each regenerator in the first and second pulse tube refrigerating means are connected through the by-pass channel, the flow amount of the working gas passing through each regenerator is restricted so that the refrigeration efficiency is much improved.

Consequently, the refrigeration efficiency is substantially improved and the power consumption is markedly decreased with respect to prior art devices because of the above described effects 1), and 2).

Effect 3) Since the magnetic material consisting of the rare-earth element and the transition metal is used for the regenerative material of the regenerator, the specific heat does not change to a lower level at even below 10 K, which enables the apparatus of the present invention to generate cryogenic temperatures of below 10 K.

Accordingly, through the effects 1), 2), and 3), a cryogenic temperature below 10 K can be created efficiently with a little power consumption, and the above describe purposes can be achieved.

In the pulse tube refrigerator of the present invention, each regenerator of the first and second pulse tube refrigerating means can be connected with a heat transfer member.

In this case, since each regenerator is connected through the heat transfer member, a two-stage type refrigerator with a simple structure can be easily obtained without increasing the number of the pulse tubes.

Further, another pulse tube refrigerator of the present invention may be provided with a refrigerating portion consisting of the above described first and second pulse tube refrigerating means, and at least another refrigerating portion having a pulse tube which is different from that of the first and second pulse tube refrigerating means, and heat exchanging means provided at the low temperature side of the pulse tube, and each regenerator can be connected in series between these refrigerating portions.

Here, the heat exchanging means of another refrigerating portion described above includes, in addition to the regenerator filled with the regenerative material, a counterflow heat exchanger which is designed to alternatively exchange the heat between working gases.

In such cases, by connecting the regenerators with each other in series between the refrigerating portions in each stage, a multi-stage type refrigerator having many refrigerating portions can be obtained.

DETAILED DESCRIPTION OF THE PREFERRED EMBODIMENT(S)

Each embodiment of the present invention will be explained with reference to the drawings as below.

Figure 1:
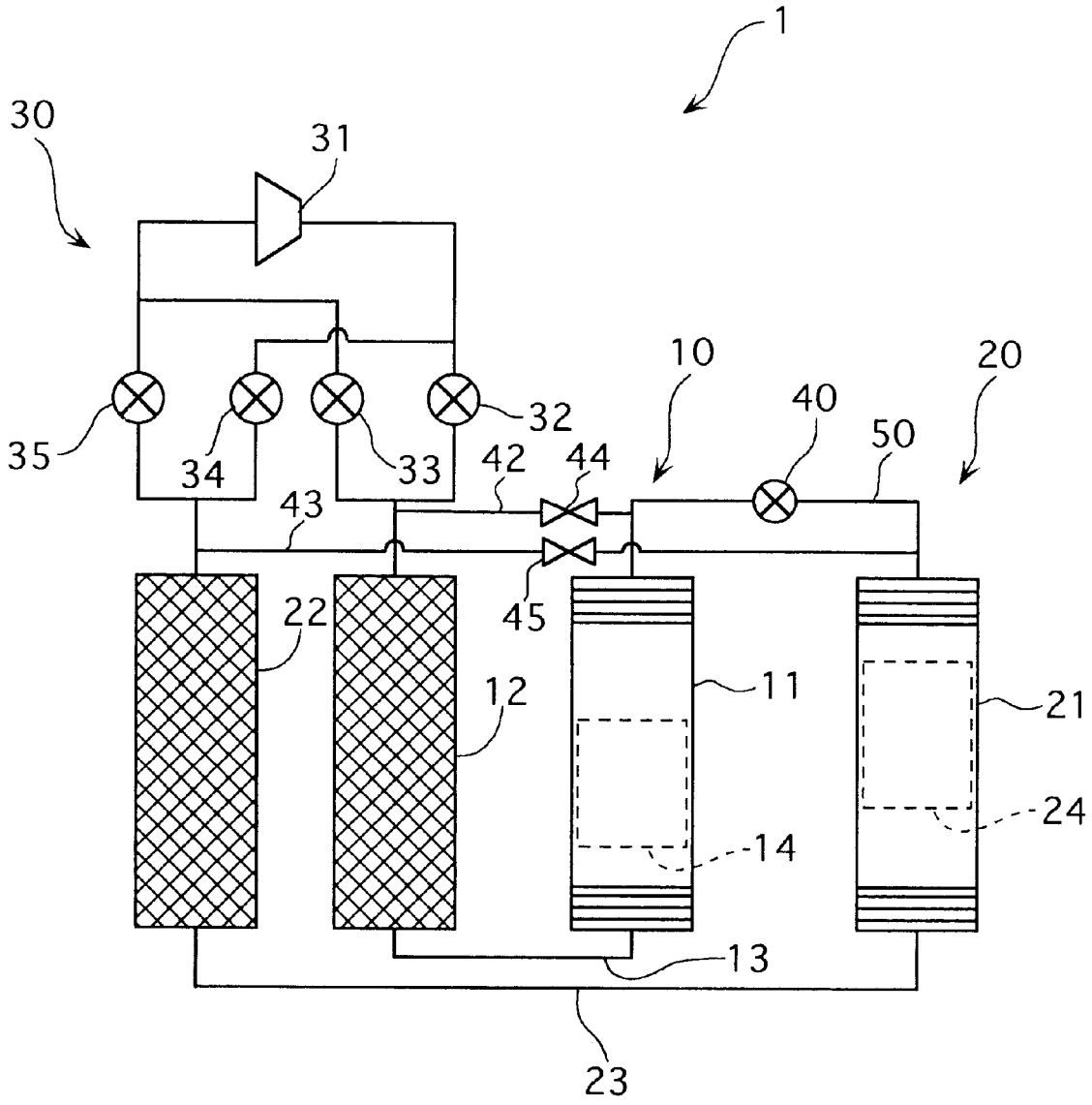
FIG. 1 is a block diagram showing a pulse tube refrigerator relating to the first embodiment of the present embodiment.

FIG. 1 is a block diagram showing a pulse tube refrigerator 1 relating to the first embodiment of the present embodiment.

In FIG. 1, the pulse tube refrigerator 1 is provided with a first pulse tube refrigerating means 10, and a second pulse tube refrigerating means 20, each pulse tube refrigerating means 10 and 20 includes pulse tubes 11 and 21, and regenerators 12 and 22, respectively provided at the low temperature side (bottom side in the figure) of the pulse tube 11 and 21, and a pressure fluctuation generating means 30 is arranged in the high temperature side (upper side in the figure) of each regenerator 12,22.

The pulse tube 11 and 21 of each pulse tube refrigerating means 10 and 20 have nearly the same diameter and length in dimensions, both high temperature sides (upper side in the figure) of each pulse tube 11 and 21 are connected to each other through a continuous channel 50 having a valve 40 for a channel opening means. The valve 40 is designed to allow the working gas to come and go intermittently through each high temperature side between the pulse tubes 11 and 21, serving as the fifth valve in the present invention. Incidentally, the first to fourth valves will be explained later.

The high temperature sides of each pulse tube 11 and 21 and the high temperature sides of each regenerator 12 and 22 are connected by by-pass channels 42 and 43, and orifices 44 and 45 are arranged at some midpoint of each by-pass channels 42 and 43.

The regenerators 12 and 22 are comprised of a member filled with a magnetic material of, for instance, spherical $Er_3Ni$ (erbium 3-nickel) having about 0.3 mm in diameter as a regenerative material in stainless tubes, and since each has nearly the same heat capacity, they are designed to generate refrigeration in the same level at each cold station 13 and 23 arranged between the pulse tubes 11 and 21, and the regenerators 12 and 22.

In detail, the regenerative material is filled with three layers extending from the high temperature side (upper side in FIG. 1) to the lower temperature side (bottom side in FIG. 1) inside the regenerators 12 and 22. The highest temperature side layer includes a copper alloy wire netting as the regenerative material. Regeneration in this layer is carried out at temperatures higher than 30 K. The second layer includes lead as the regenerative material. The regeneration in this layer is carried out in the temperature range of 10 K to 30 K. The lowest temperature side layer is filled with the magnetic $Er_3Ni$ (erbium 3-nickel) of about 0.3 mm in particle diameter as the regenerator. The regeneration in this layer is carried out in the cryogenic temperature of below 10 K.

The formation of this multi-layer constitution makes it possible to efficiently carry out the regeneration, creating cold temperatures from higher than 30 K to below 10 K, making the best use of the property of each regeneration agent.

It is also acceptable to make a double layer type which consists of copper alloy in the high temperature side and erbium 3-nickel in the low temperature side, omitting the intermediate lead layer. Through this constitution, the effect of the multiple layers type for improving the cooling efficiency can be still obtained, though not so effectively as with the triple layer constitution.

The pressure fluctuation generating means 30 is provided with a compressor 31 in which the left side in the figure is designated to be a low pressure side and the right side in the figure a high pressure side, the first and second valves 32 and 34 for the high pressure use arranged between the high pressure side of the compressor 31 and the high temperature sides of each regenerator 12 and 22, and the third and fourth valves 33 and 35 for the low pressure use arranged between the high temperature sides of each regenerator 12 and 22, and the low pressure side of the compressor 31. By opening and closing each valve 32 to 35 in designated timing, the pressure fluctuation of the working gas such as helium gas and the like is generated at a phase difference angle of 180° in each pulse tube 11 and 12. Namely, in the present embodiment, each valve 32 to 35 is a channel exchanging means relating to the present invention.

Figure 3:
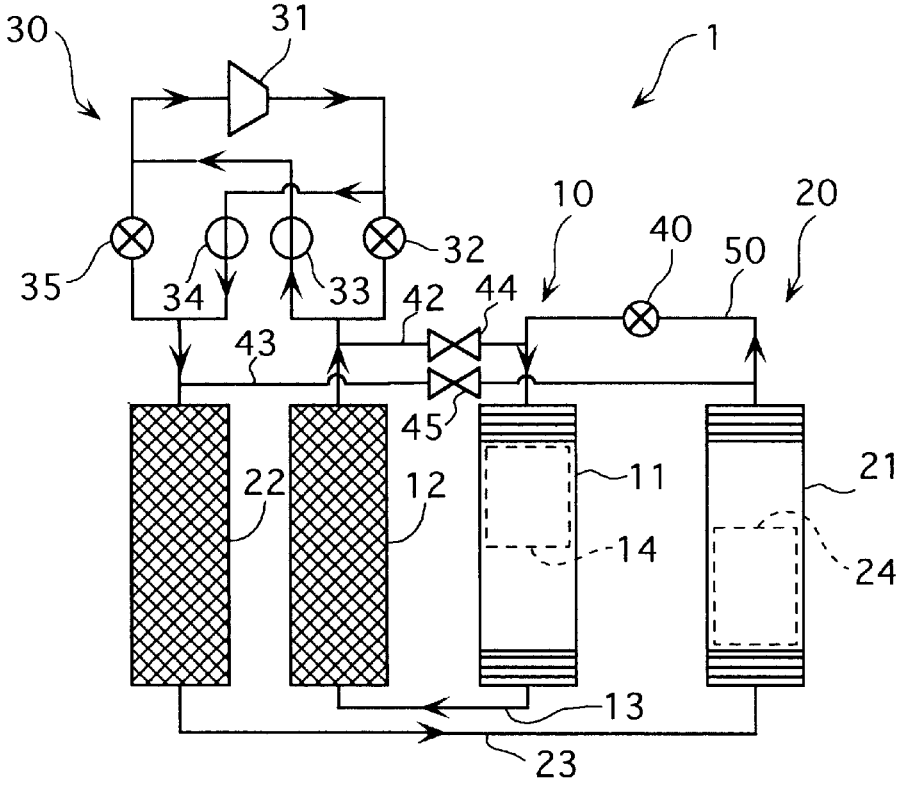
FIG. 3 is an explanatory view to explain the movement of the pulse tube refrigerator.
Figure 3:
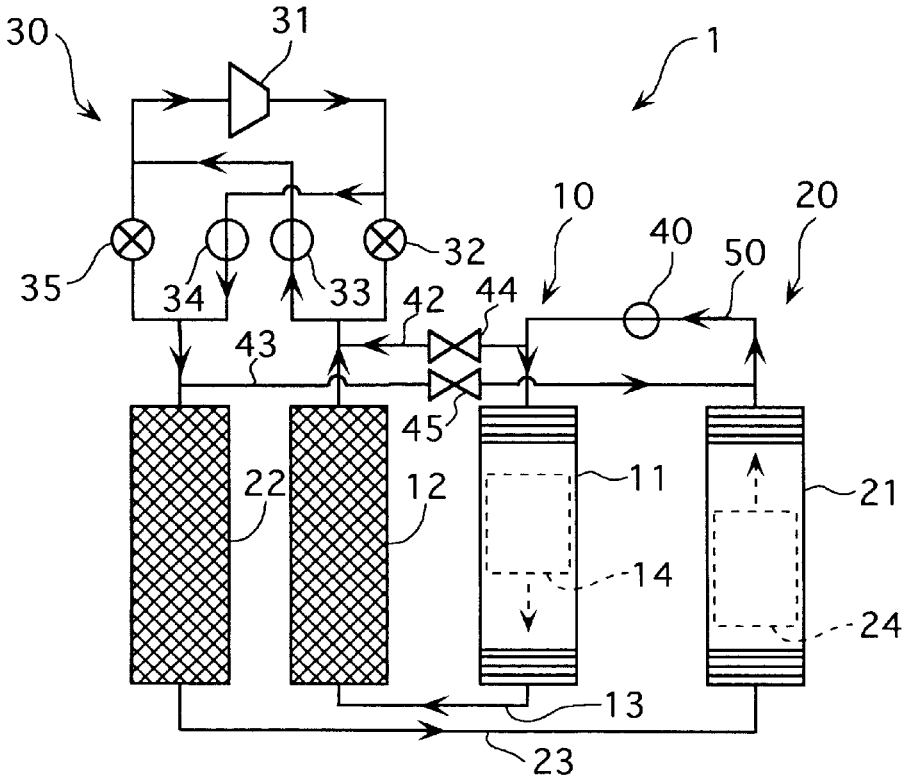
Figure 4:
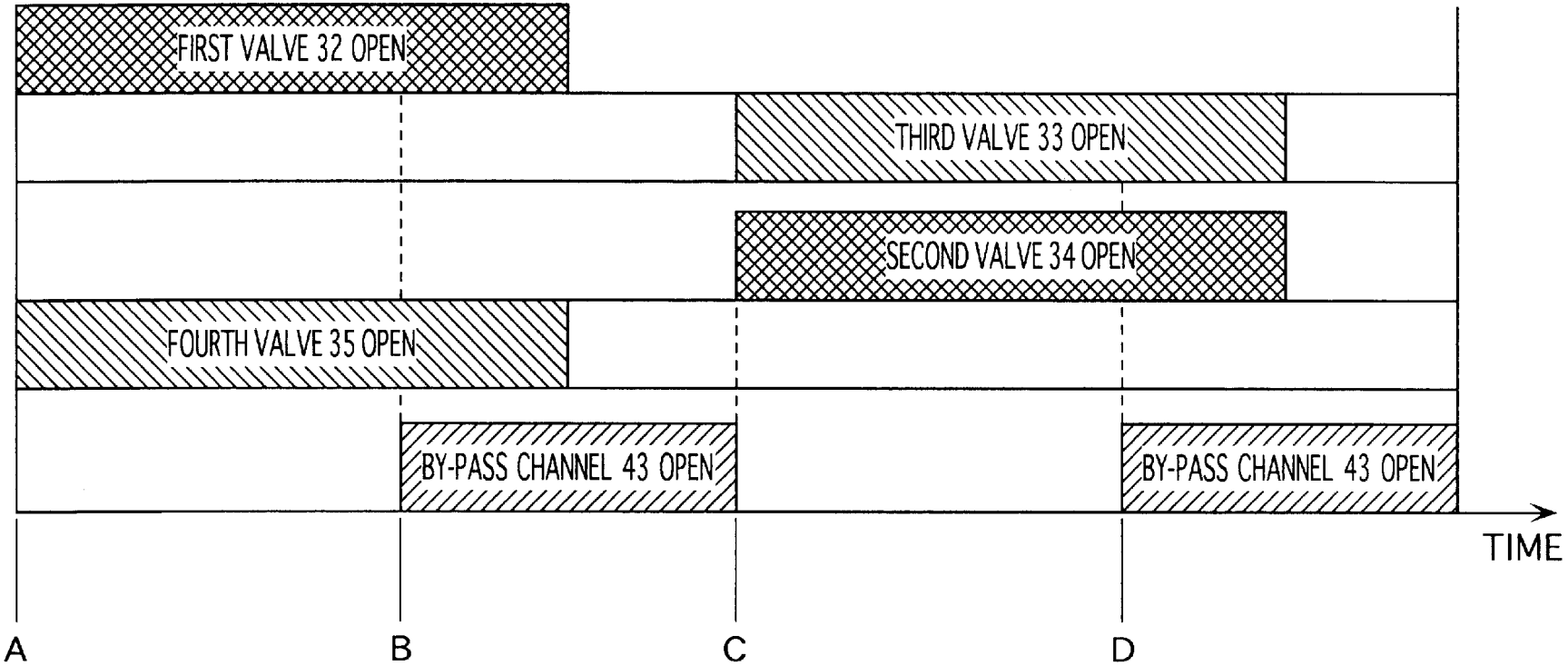
FIG. 4 is a motion diagram showing the motion of valves composing the pulse tube refrigerator.

The operation of the pulse tube refrigerator 1 will be explained with reference to the drawings of FIG. 2, FIG. 3, and FIG. 4.

Figure 2:
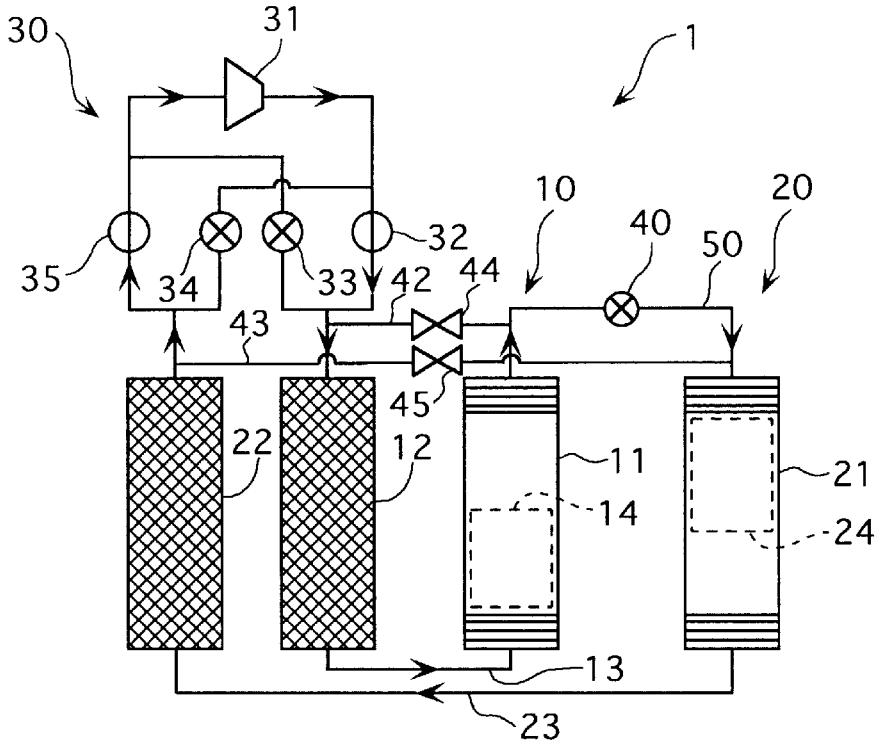
FIG. 2 is an explanatory view toeplanatory to explain the movement of the pulse tube refrigerator.
Figure 2:
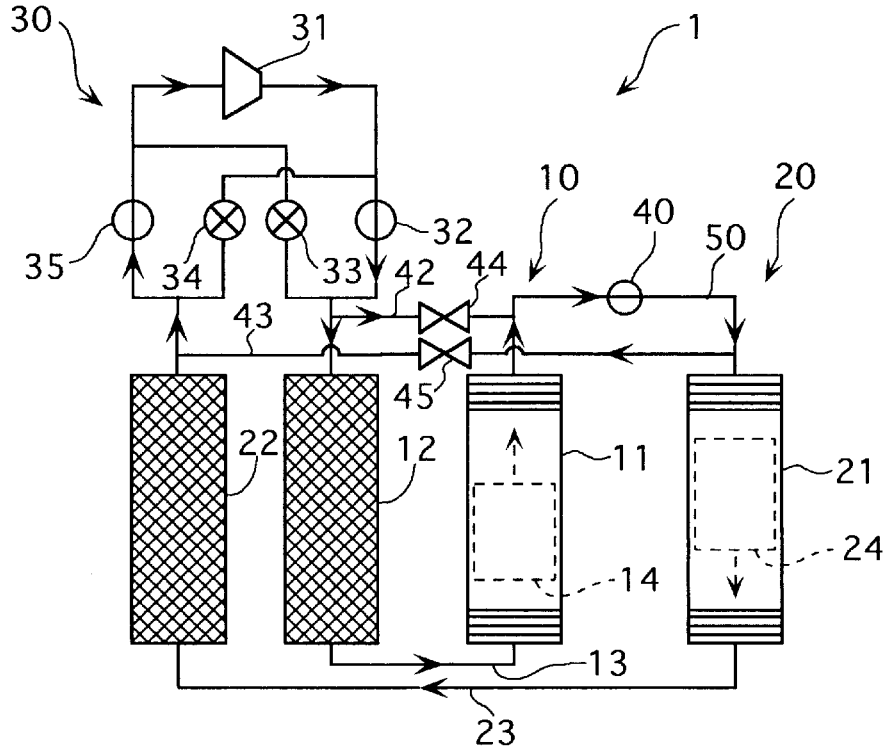

As shown in FIG. 2 (A), in a state where a gas column 14 in the pulse tube 11 of the first pulse tube refrigerating means 10 is at the end of the low temperature side (shown by the dotted lines) and a gas column 24 in the pulse tube 21 of the second pulse tube refrigerating means 20 is at the end of the high temperature side (shown by the dotted lines), the first valve 32 in the regenerator 12 side and the fourth valve 35 in the regenerator 22 side are opened to send the working gas into the first pulse tube refrigerating means 10 (at time of A in FIG. 4), then the pressure fluctuation of the working gas is generated within each pulse tube 11 and 21 at the phase difference angle of 180°.

Then, as shown in FIG. 2(B), a portion of the working gas goes in the high temperature side of the pulse tube 11 through the by-pass channel 42, but most working gas flows into the pulse tube 11 from the low temperature side. Through this movement, the gas column 14 moves from the low temperature side to the high temperature side in the pulse tube 11, and by opening the fifth valve 40 at a designated time (at time of B in FIG. 4), the working gas that previously existed in a higher temperature side than the place where the gas column 14 exists, flows into the high temperature side of the pulse tube 21 through the continuous channel 50. On this occasion, the phase angle between the pressure and amount of flow affecting pressures in each of the two pulse tubes 11 and 21, is optimized by automatic control of the opening timing of the fifth valve 40.

Accompanied by the above, in the second pulse tube refrigerating means 20, a portion of the working gas intended to flow into the high temperature side of the pulse tube 21 returns to the high temperature side of the regenerator 22 through the by-pass channel 43, but most working gas flows into the pulse tube 21. There in the pulse tube 21, the gas column 24 moves from the high temperature side to the low temperature side due to the working gas coming from the high temperature side and due to the opening of the fourth valve 35. At this time, the working gas existing in a lower temperature side than the place where the gas column 24 locates, expands to lower itself in temperature, and returns to the low pressure side in the compressor 31, cooling the low temperature side of the regenerator 22.

After that the gas columns 14 and 24 take place at the high temperature side end of the pulse tube 11 and the low temperature side end of the pulse tube 21, as shown in FIG. 3(A). In this state, the first valve 32 and the fourth valve 35 are closed. After an interval, the fifth valve 40 is closed, while the third valve 33 of the regenerator 12 and the second valve 34 of the regenerator 22 are opened. (at time C in FIG. 4).

Just then, as shown in FIG. 3(B), a portion of the working gas flows into the high temperature side of the pulse tube 21 through the by-pass channel 43, but the major portion of the working gas is cooled by passing through the regenerator 22 and flows into the low temperature side of the pulse tube 21. Through this process, the gas column 24 in the pulse tube 21 moves from the low temperature side to the high temperature side, and at the same time, the above described working gas flowing in the higher temperature side than the place where the gas column 24 exists, returns to the high temperature side of the pulse tube 11 through the continuous channel 50 again by opening the fifth valve 40.

A portion of the working gas which intends to return to the high temperature side of the pulse tube 11 returns to the high temperature side of the regenerator 12 through the by-pass channel 42, but the major portion of the working gas returns into the pulse tube 11. Therefore, in the pulse tube 11, the gas column 14 returns from the high temperature side to the low temperature side, due to the working gas returned from the high temperature side, and due to the opening of the third valve 33. At this time, the working gas which flows in a lower temperature side than the place where the gas column 14 exists, expands to lower itself in temperature by opening of the third valve 33, and returns to the low pressure side of the compressor 31, refrigerating the low temperature sides of the cold station 13 and the regenerator 12.

Now, the pulse tube refrigerator I has finished the one cycle and returns to the state shown in FIG. 2(A). And by repeating the cycle, the low temperature side of the regenerators 12 and 22 are decreased in temperature and attain reaches cryogenic temperatures of below 10 K at the cold stations 13, and 23.

The following effects can be expected according to the present embodiment.

Effect 1) In the pulse tube refrigerator 1, since the high temperature sides of the pulse tube 11 and 21 are connected to each other through the continuous channel 50 in the first and the second pulse tube refrigerating means 10 and 20, when the refrigeration is generated in the pulse tube refrigerating means 10 (20), a portion of the working gas moves from the high temperature side of the pulse tube 11 (21) of the pulse tube refrigerating means 10 (20) to the high temperature side of the pulse tube 21 (11) of the pulse tube refrigerating means 20 (10), and through this movement, the phase angle between the pressure fluctuation inside the pulse tube 11 (21) in the pulse tube refrigerating means 10 (20) and the displacement of the gas column 14 (24) can be optimized. Accordingly there is no need to provide the conventional buffer or to provide orifices or valves and so on in the high temperature side of the pulse tube to optimize either the phase angle between the pressure fluctuation in each pulse tube 11 and 21, or the displacement of the operation gas in the first and second pulse tube refrigerating means 10 and 20. Therefore and advantageously, the conventional sophisticated phase control mechanism is not required, an excess compression work of the pressure fluctuation generator 30 can be omitted, and the refrigeration efficiency can be improved.

Effect 2) Since the by-pass channels 42 and 43 are arranged in the high temperature sides of the pulse tubes 11 and 21 and in the high temperature sides of the regenerators 12 and 22, the flow amount of the working gas passing though each regenerator 12 and 22 can be controlled in accordance with the opening of the orifices 44 and 45, and the heat exchange between the working gas and the regenerator 12 and 22 can be performed within a second. Thus, the refrigeration effect can be improved from this point of view.

The refrigeration efficiency can be substantially improved, and the power consumption can be markedly decreased due to the above described effects 1) and 2).

Effect 3) Since $Er_3Ni$, which is the magnetic material composed of the rare-earth element, and the transition metal are used as the regenerative material for the regenerators 12 and 22, the specific heat of the regenerative material does not become smaller even below the temperature of 10 K. Therefore the regenerator effectively generates the cryogenic temperature of, for instance, 4 K or so.

Effect 4) Since a buffer such as the conventional orifice type or double inlet type is not necessary, the whole refrigerator can be miniaturized.

Effect 5) Since the high temperature sides of each pulse tube 11 and 21 are connected to each other through the fifth valve 40, the optimum phase angle can be easily obtained by automatic control of opening and closing of the fifth valve 40 with designated timing.

Since the fifth valve 40 is opened or closed at a designated time, the control is easy.

Effect 6) Since the fifth valve 40 is provided, control of the opening of the valve is not necessary for obtaining the most suitable flow amount of the working gas flowing between each pulse tube 11 and 21, so adjustment after installation of the refrigerator 1 can be simplified.

Figure 5:
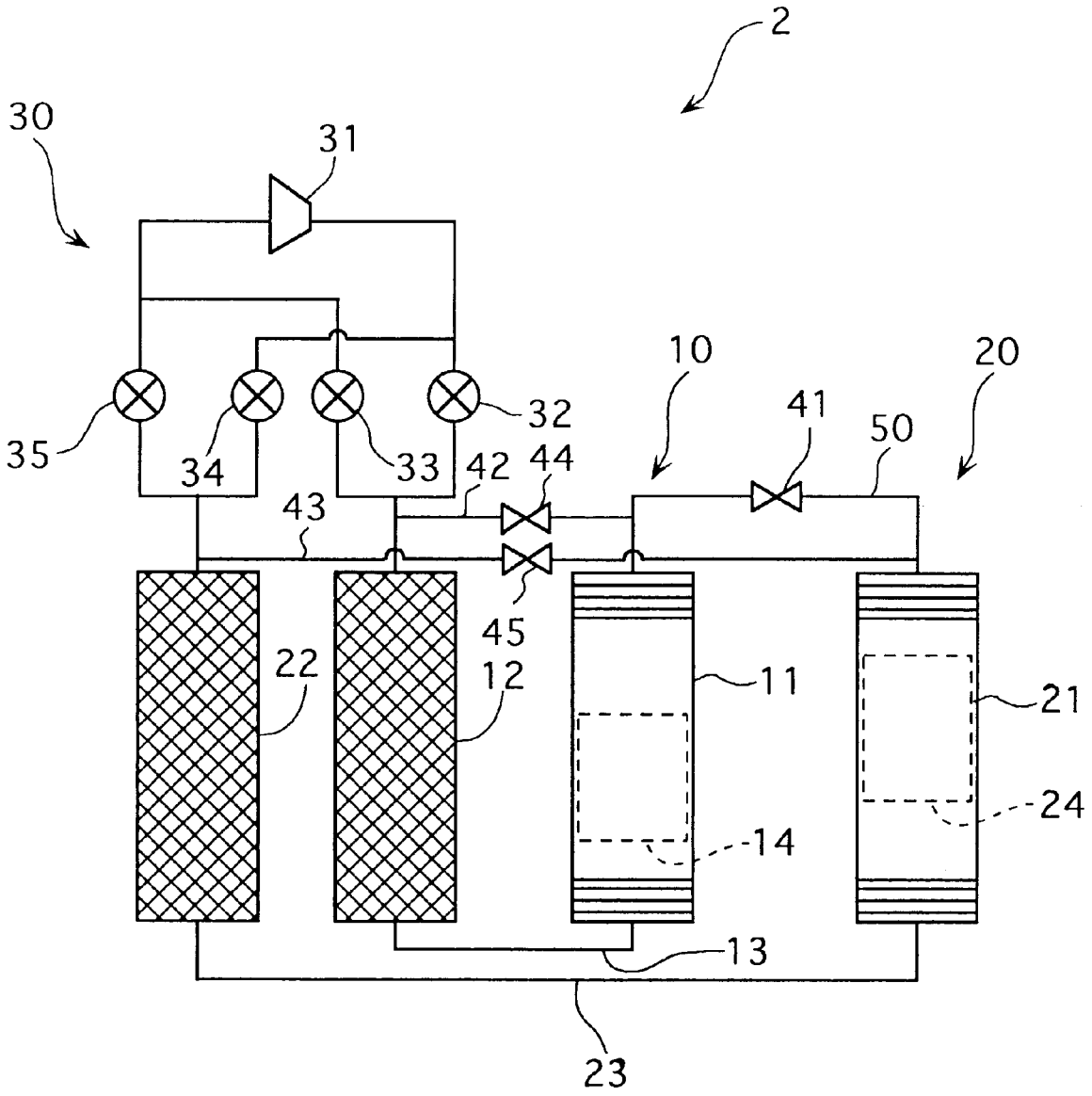
FIG. 5 is a block diagram showing a pulse tube refrigerator relating to the second embodiment of the present embodiment.

FIG. 5 shows a pulse tube refrigerator 2 relating to the second embodiment of the present invention.

In FIG. 5, the pulse tube refrigerator 2 replaces the fifth valve 40 (FIG. 1) of the above described refrigerator 1 with an opening adjustable orifice 41 which serves as an amount of flow adjustment means. Other constituents are the same as those of the refrigerator 1.

In the pulse tube refrigerator 2, the opening of the orifice 41 is adjusted in advance so that the amount of flow of the working gas passing through the high temperature sides of the pulse tubes 11 and 21 is optimized. Through this adjustment, once the working gas flows in the low temperature side of the pulse tube 11, almost at the same time, the working gas in a higher temperature side than the place where the gas column 13 locates in, can flow in the high temperature side of the pulse tube 21, the amount of flow of the working gas being adjusted through the orifice 41.

In reverse, at almost the same time that the working gas flows in the low temperature side of the pulse tube 21, the working gas existing in a higher temperature side than the place where the gas column 23 locates in, flows into the high temperature side of the pulse tube 11, the amount of flow being adjusted.

The present embodiment ensures the following effect in addition to similar effects as from 1) to 4) in the first embodiment due to the characteristic constitution.

Effect 7) Since the high temperature sides of the pulse tubes 11 and 21 are connected through the opening-adjustable orifice 41, the most suitable amount of flow of the working gas passing between each pulse tube 11 and 21 can be obtained only by adjusting the opening of the orifice 41, and the optimum phase angle in accordance with the sizes of the pulse tubes 11 and 21 can be obtained. Accordingly, even when the sizes of the pulse tubes 11 and 21 are changed, adjusting the opening of the orifice 41 is the only compensatory adjustment so it is easy to respond to such changes.

Figure 6:
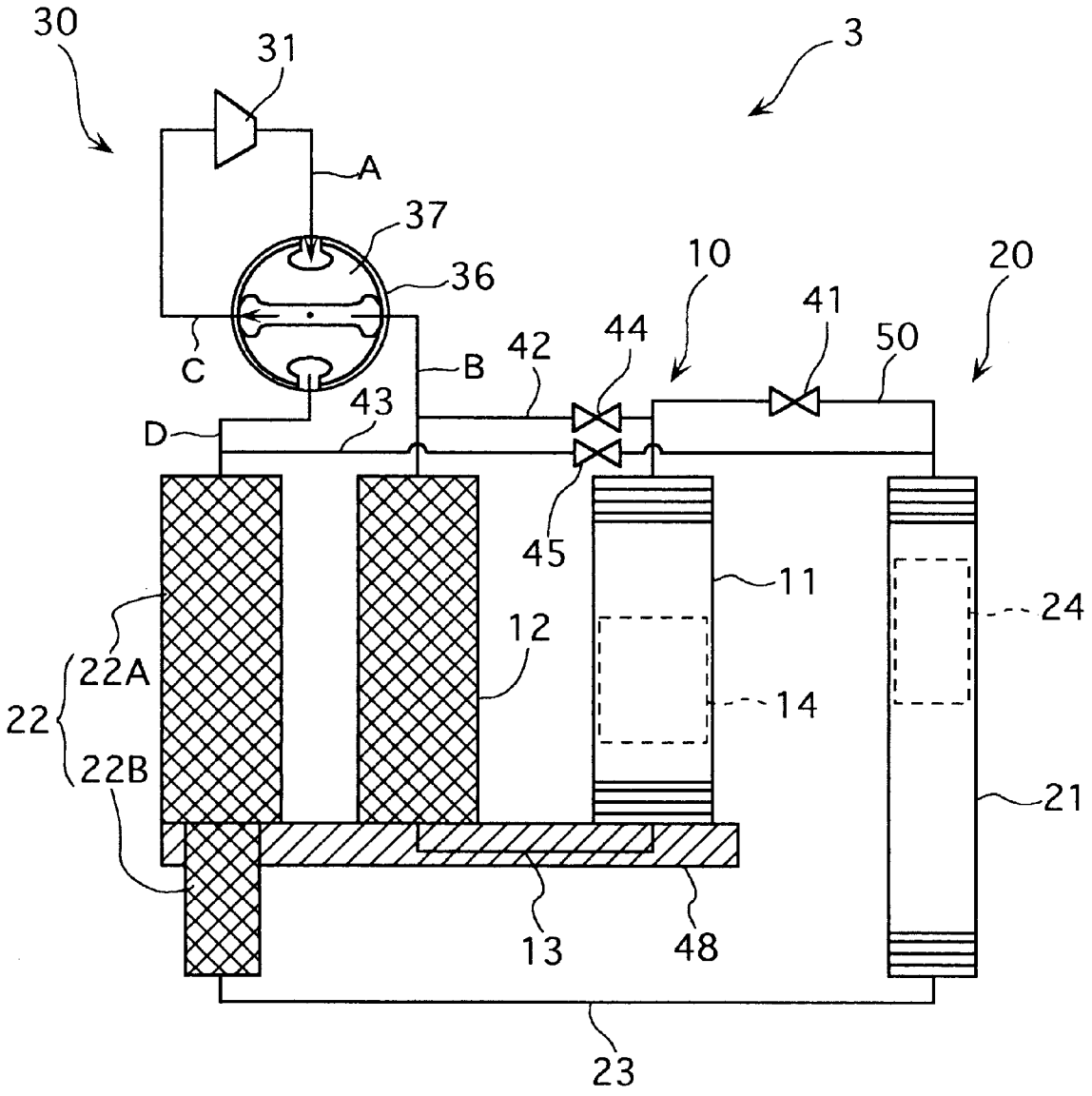
FIG. 6 is a block diagram showing a pulse tube refrigerator relating to the third embodiment of the present embodiment.

FIG. 6 shows a pulse tube refrigerator 3 relating to the third embodiment of the present invention.

In FIG. 6, since the pulse tube refrigerator 3 has similar constituent member as those in the previously described embodiments, these similar constituent members are designated with the same marks, and the explanation for them is simplified or omitted.

As between the pulse tubes 11 and 21 of the pulse tube refrigerating means 10 and 20 of the refrigerator 3, the pulse tube 21 of the second pulse tube refrigerating means 20 has a smaller diameter and longer length in dimension than the dimension of the pulse tube 11 of the first pulse tube refrigerating means 10.

Among each regenerator 12 and 22, the regenerator 22 provided in the high temperature side of the pulse tube 21 is formed with the first regenerator 22A in the high temperature side and the second regenerator 22B in the low temperature side, connecting in series to each other.

The regenerators 12 and 22A comprise several sheets of copper screen disks used as a regenerative material piled in a stainless tube, or spherical shaped particles of lead having diameters of 0.3 mm as the regenerative material filled in a stainless tube, both having almost the same heat capacity. And in the regenerator 22B which has smaller external dimensions than those of the regenerators 12 and 22A, $Er_3Ni$ is used as the regenerative material, as in the first embodiment, and the heat capacity of the whole second regenerator 22 is larger than that of the first regenerator 12 by the portion of the regenerator 22B.

A connecting portion (the low temperature side of the regenerator 22A and the high temperature side of the regenerator 22B) between the regenerator 22A and the regenerator 22B is connected to the low temperature side of the regenerator 12, the cold station 13, and the low temperature side of the pulse tube 11 by a heat transfer member 48 which is made of metal and has an excellent thermal conductivity, and the whole heat transfer member 48 acts as the cold station of the first pulse tube refrigerating means 10.

Further, in the present embodiment, the pressure fluctuation regenerating means 30 is configured with including a rotary valve 36 as a channel exchanging means. The rotary valve 36 connects between a high pressure side channel A of the compressor 31 and a channel D of the regenerator 22 side by a rotating rotor 37 at a certain angle, and at the same time connects between a channel B of the regenerator 12 side and a channel C of the low pressure side of the compressor 31. The rotary valve 36 is also formed to connect between the channel A and B, and at the same time, between the channel C and D at an another angle of rotation. Through this function, the working gas is alternatively supplied to the first and second pulse tube refrigerating means 10, 20 and the pressure fluctuation is generated at the phase difference angle of 180°.

In such pulse tube refrigerator 3, since the regenerator 12 and 22 are connected to each other through the heat transfer member 48, the regenerator 22 having a large heat capacity receives the coldness from the regenerator 12 and is further cooled, and the temperature in the cold station 23 arranged between the regenerator 22 and the pulse tube 21, falls below the temperature in the cold station 13. Then, since the magnetic material $Er_3Ni$, which is composed of the rare-earth element and the transition metal, is used as a regenerative material in the second regenerator 22B which forms part of the regenerator 22, the cryogenic temperature of 4 K or so can be obtained in the cold station 23.

The present embodiment has the following effects in addition to the above described effects of 1) to 4) and 7).

Effect 8) In the refrigerator 3, since the regenerators 12 and 22 are connected to each other through the heat transfer member 48, the cold station 23 becomes lower in temperature than the temperature of the cold station 13. Therefore, by placing the first pulse tube refrigerating means 10 having the cold station 13 at a first stage, and the second pulse tube refrigerating means 20 having the cold station 23 at a second stage, the refrigerator 3 can be a simply structured two-stage refrigerator with no need to increase the number of the pulse tubes.

Effect 9) By forming the two-stage type, two different objects of refrigeration can be cooled at different temperatures.

Effect 10) Since the pressure fluctuation generating means 30 comprises the compressor 31 and the rotary valve 36, the downsizing of the pressure fluctuation generating means 30 can be accelerated with respect to the use of the first to fourth valves 32 to 45.

Figure 7:
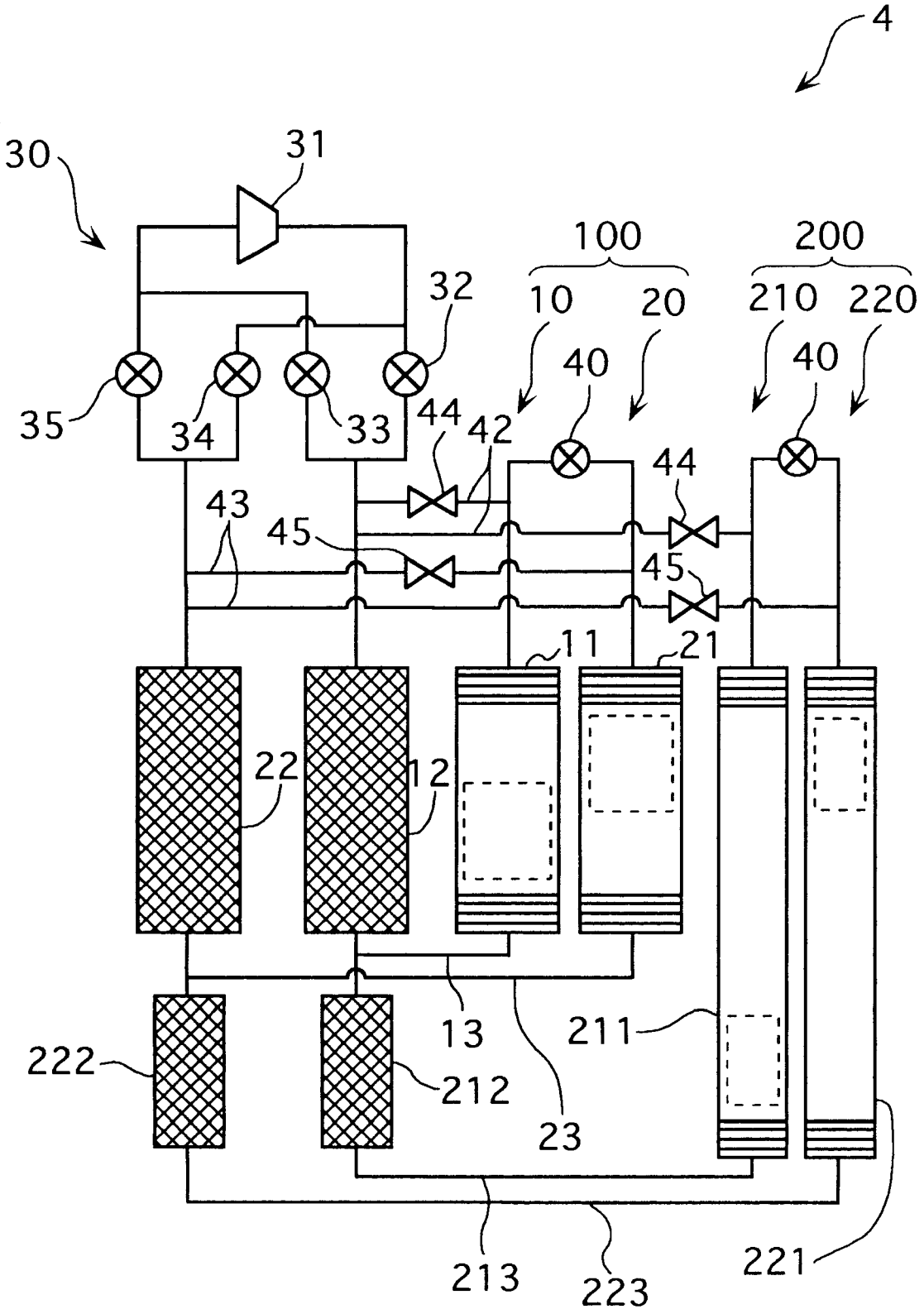
FIG. 7 is a block diagram showing a pulse tube refrigerator relating to the fourth embodiment of the present embodiment.

FIG. 7 shows a pulse tube refrigerator 4 relating to the fourth embodiment of the present invention.

In FIG. 7, the refrigerator 4 has the first stage refrigerating portion 100 comprising pulse tube refrigerating means 10 and 20, and the second stage refrigerating portion 200.

In the first stage refrigerating portion 100, the copper screen disks or the spherically shaped lead explained in the second embodiment are used as the regenerative material for the regenerators 12 and 22. Incidentally, in the first stage refrigerating portion 100, a counter flow type heat exchanger which is designed to alternatively perform heat exchange between the working gases, can be used, or any other heat exchanging means can be used.

The second stage refrigerating portion 200 is provided with the first and second pulse tube refrigerating means 210 and 220. The pulse tube refrigerating means 210 and 220 consist of pulse tubes 211 and 221 having a smaller diameter and a longer length than those of the pulse tubes 11 and 22, and regenerators 212 and 222 arranged in the high temperature side of the pulse tube 211 and 221. The high temperature sides of the pulse tubes 211 and 221 and the high temperature sides of the regenerators 12 and 22 (the high temperature sides of the regenerators 212 and 222) are connected through the by-pas channels 42 and 43 having the orifices 44 and 45 in a similar manner.

In the regenerators 212 and 222, the high temperature sides are connected in series with the low temperature sides of the regenerator 12 and 22 through channels. And for the magnetic material composed of the rare-earth element and the transition metal, $Er_3Ni$ is used as the regenerative material for the regenerators 212 and 222.

In such a refrigerator 4, since the first and second stage refrigerating portions 100 and 200 are provided and the regenerators 12, 22, 212, and 222 are connected in series between the refrigerating portions 100 and 200 of each stage, the temperature at the cold stations 213 and 223 arranged in the second stage refrigerating portion 200 is lower than the temperature at the cold stations 13 and 23. That is, since copper, copper alloy and lead are used as the regenerative material for the regenerators 12 and 22, the cryogenic temperatures of 30 K or higher than 10 K can be obtained in the cold stations 13 and 23 of the first stage refrigerating portion 100, and since $Er_3Ni$ is used as the regenerative material for the regenerators 212 and 222, the cryogenic temperature of 4 K or so can be obtained in the cold station 213 and 223 of the second stage refrigerating portion 200.

Therefore, since the refrigerator 4 of the present embodiment includes the above explained second stage refrigerating portion 200, the following effect can be expected in addition to the above described effects of 1) to 6).

Effect 11) Since the refrigerator 4 is provided with the first and second stage refrigerating portions 100 and 200, which generate the cryogenic atmospheres of different temperature level, the refrigerator 4 can be a two-stage refrigerator, though different from the third embodiment in constitution.

It should be mentioned that the present invention is not limited to the above described embodiments, but includes other configurations which can achieve the purposes of the present invention, such as the following modifications.

For instance, the regenerative material in the above described embodiments, is the magnetic material consisting of $Er_3Ni$, the regenerative material relating to the present invention is not limited to this. That is, the rare-earth element for the regenerative material can be chosen from Y, La, Ce, Pr, Nd, Pm, Sm, Eu, Gd, Tb, Dy, Ho, Tm, Yb, in addition to Er, and the transition metal can be chosen from Co, Cu, in addition to Ni.

In each embodiment above described, the fifth valve 40 or the orifice 41 is provided in the continuous channel 50 which connects the high temperature sides of the pulse tubes to each other. The present invention further includes the configuration which has neither the fifth valve 40 nor the orifice 41. Rather, by adjusting the diameter and the length of the continuous channel 50 itself in advance so that the optimum amount of the working gas flow can be obtained, the fifth valve 40 or the orifice 41 can be omitted.

In the third embodiment, the pressure fluctuation generating means 30 includes the compressor 31 and the rotary valve 36, but the valves 32 to 35 in the first, second, and fourth embodiments can be used instead of the rotary valve 36, alternatively, the rotary valve 36 can be used in the first, second, and the fourth embodiments.

The regenerative material for the regenerators 12 and 22A in the third embodiment, and the regenerative material for the regenerators 12 and 22 in the fourth embodiment are, respectively, copper, copper alloy or lead which create the cryogenic temperatures of higher than or equal to 30 K or 10 K. A magnetic material consisting of the above described composition can be used for the regenerative material to create an atmosphere having such a temperature level. But the amount of the magnetic material can be decreased and as a result, the cost reduced by using the regenerative material described in the embodiments.

In the fourth embodiment, the pulse tube refrigerator 4 is the two-stage type having plural refrigerating portions, but the pulse tube refrigerator of the present invention can be the multiple stage type including the three or more stages type which adds refrigerating portions to the above two-stage type.

In the fourth embodiment, the by-pass channels 42 and 43 are provided with the first and second stage refrigerating portions 100 and 200, but the configuration without the by-pass channels 42 and 43 of the first stage refrigerating portion 100 is also included within the present invention. In other words, in the pulse tube refrigerator of the multi-stage type consisting of plural refrigerating portions, the by-pass channel is provided with the refrigerating portion having the regenerator which uses the magnetic material composing of the rare-earth element and the transition metal as the regenerative material. However, it is preferable to provide the by-pass channels to each stage for improvement of the refrigeration efficiency.

What is claimed is:

1. A pulse tube refrigerator, comprising:

a first pulse tube refrigerating means and a second pulse tube refrigerating means each having a respective pulse tube and a respective regenerator provided at a low temperature side of the associated pulse tube;

a pressure fluctuation generating means to generate a pressure fluctuation of a working gas provided at a high temperature side of each regenerator of the first and second pulse tube refrigerating means;

a continuous channel connecting the high temperature sides of each pulse tube of said first and second pulse tube refrigerating means to each other;

a by-pass channel connecting the high temperature side of the pulse tube in said first pulse tube refrigerating means and the high temperature side of the regenerator and at the same time, connecting the high temperature side of the pulse tube in said second pulse tube refrigerating means and the high temperature side of the regenerator; and at least one regenerator among said regenerators containing a rare-earth element magnetic material composition and a transition metal as a regenerative material.

2. The pulse tube refrigerator according to claim 1, wherein an orifice having an adjustable opening is provided at a midpoint of said by-pass channel.

3. The pulse tube refrigerator according to claim 1, wherein each regenerator in said first and second pulse tube refrigerating means is connected through a heat transfer member.

4. The pulse tube refrigerator according to claim 3, wherein said heat transfer member is connected between the low temperature side of the regenerator in the first pulse tube refrigerating means and near the center along the flow direction of the working gas in the regenerator of the second pulse tube refrigerating means.

5. The pulse tube refrigerator according to claim 4, wherein the regenerator of said second pulse tube refrigerating means includes a first regenerator arranged at the high temperature side and a second regenerator arranged at the low temperature side of the regenerator, and a border portion of the first and second regenerators and the low temperature side of the regenerator of said first pulse tube refrigerating means are connected with said heat transfer member.

6. The pulse tube refrigerator according to claim 1, further including at least one additional pulse tube refrigerating means having at least one pulse tube and at least one heat exchanging means Provided at a low temperature side of said at least one pulse tube, said regenerators of said first and second pulse tube refrigerating means and said at least one heat exchanging means being connected in series between said first and second pulse tube refrigerating means and said at least one additional pulse tube refrigerating means.

7. The pulse tube refrigerator according to claim 1, wherein a flow amount adjusting means is provided in said continuous channel.

8. The pulse tube refrigerator according to claim 7, wherein the flow amount adjusting means is an orifice.

9. The pulse tube refrigerator according to claim 8, wherein said continuous channels are connected through channel closing means.

10. The pulse tube refrigerator according to claim 9, wherein said channel closing means is a valve designed to allow the working gas to intermittently pass therethrough.

11. The pulse tube refrigerator according to claim 1, wherein said pressure fluctuation generating means includes a compressor compressing the working gas, and a channel change-over means designed to alternatively supply the working gas which is compressed by the compressor, to said first and second pulse tube refrigerating means and, at the same time, alternatively send back the working gas expanded by said second pulse tube refrigerating means to the lower temperature side of said compressor.

12. The pulse tube refrigerator according to claim 11, wherein said channel change-over means is includes a first valve arranged in a channel between the high pressure side of said compressor and the first pulse tube refrigerating means, a second valve arranged in a channel between the high temperature side of the compressor and the second pulse tube refrigerating means, a third valve arranged in a channel between the first pulse tube refrigerating means and the low temperature side of the compressor, and a fourth valve arranged in a channel between the second pulse tube refrigerating means and the low temperature side of the compressor, and said first and fourth valves open and close at the same time, and said second and third valves open and close at the same time.

13. The pulse tube refrigerator according to claim 11, wherein said channel change-over means is arranged to connect the high pressure side of said compressor with any one of the first or second pulse tube refrigerating means (defined as A), and at the same time connect the low temperature side of the compressor with the other pulse tube refrigerating means (defined as B), and is a rotary valve which is designed to connect the high temperature side of the compressor with the other pulse tube refrigerating means described above (B means), and at the same time, connect the low temperature side of the compressor with said one of the pulse tube refrigerating means (A means).

14. The pulse tube refrigerator according to claim 1, wherein said rare-earth element used for the regenerative material is selected from the group consisting of Y, La, Ce, Pr, Nd, Pm, Sm, Eu, Gd, Tb, Dy, Ho, Er, Tm, and Yb, and the transition metal is selected from the group consisting of Ni, Co, and Cu.

15. A pulse tube refrigerator, comprising:

a first pulse tube refrigeration stage and a second pulse tube refrigeration stage each having a respective pulse tube and a respective regenerator provided at a low temperature side of the associated pulse tube;

a pressure fluctuation generator provided at a high temperature side of each regenerator of the first and second pulse tube refrigeration stage to generate a pressure fluctuation of a working gas;

a continuous channel connecting the high temperature sides of each pulse tube of said first and second pulse tube refrigeration stages to each other;

a by-pass channel connecting the high temperature side of the pulse tube in said first pulse tube refrigeration stage and the high temperature side of the regenerator, and at the same time, connecting the high temperature side of the pulse tube in said second pulse tube refrigeration stage and the high temperature side of the regenerator; and at least one regenerator among said regenerators containing a rare-earth element magnetic material composition and a transition metal as a regenerative material.

* * * * *